US006932676B2

(12) United States Patent
Troia et al.

(10) Patent No.: US 6,932,676 B2
(45) Date of Patent: Aug. 23, 2005

(54) BLASTING APPARATUS AND PROCESS FOR ACCELERATING BLAST MEDIA

(75) Inventors: Phillip Troia, Akron, OH (US); Peter F. Loyd, Medina, OH (US); Mark Nicholson, Medina, OH (US)

(73) Assignee: Foundry Sales and Supply, Inc., Cleveland, OH (US)

( * ) Notice: Subject to any disclaimer, the term of this patent is extended or adjusted under 35 U.S.C. 154(b) by 287 days.

(21) Appl. No.: 10/385,214

(22) Filed: Mar. 10, 2003

(65) Prior Publication Data

US 2005/0085165 A1 Apr. 21, 2005

(51) Int. Cl.[7] ..... B24C 3/02; B24C 5/06
(52) U.S. Cl. ..... 451/38; 451/87; 451/91
(58) Field of Search ..... 451/38, 39, 40, 451/75, 87, 88, 89, 91, 95, 96, 97, 102

(56) References Cited

U.S. PATENT DOCUMENTS 4,028,851 A * 6/1977 Fricke ..... 451/77
5,441,443 A * 8/1995 Roberts ..... 451/91
5,702,289 A * 12/1997 Champaigne ..... 451/38
6,126,516 A * 10/2000 Barrier et al. ..... 451/38

* cited by examiner

*Primary Examiner*—Jacob K. Ackun, Jr.
(74) *Attorney, Agent, or Firm*—Renner, Otto, Boisselle & Sklar, LLP

(57) ABSTRACT

This invention relates to a blasting apparatus, comprising: a fan mounted for rotation in a first horizontal plane about a vertically oriented axis of rotation; a dispensing plate mounted for rotation in a second horizontal plane about the vertically oriented axis of rotation, the second horizontal plane being positioned below the first horizontal plane; and a passage configured to deliver blast media to the dispensing plate. A process for accelerating blast media is disclosed.

25 Claims, 1 Drawing Sheet

BLASTING APPARATUS AND PROCESS FOR ACCELERATING BLAST MEDIA

TECHNICAL FIELD

This invention relates to a blasting apparatus and to a process for accelerating a blast media. The inventive apparatus and process are suitable for delivering blast media to a work area without destroying a large percentage of the delivered blast media.

BACKGROUND OF THE INVENTION

It is often desirable to clean a surface by hurling small particles of blast media against the surface, such as to remove paint, rust and/or other coatings or built-up debris. In other situations, blasting the surface of an article may impart desirable qualities to the surface. One such situation in which this occurs is in the aerospace industry, where it has been found that blasting a surface of an article will place the surface of the article in compressive stress. This has been found to reduce the likelihood that the surface will crack or otherwise degrade when undergoing cyclic loading. Stressing the surface of an article by blasting the surface is referred to as peening. The term "blast" and "blasting" will be used herein generically to refer to any application in which small particles are hurled at a surface at a relatively high rate of speed. Exemplary applications include cleaning, descaling, deburring, deflashing, peening, etching, product appearance enhancement and numerous other similar applications.

There are two main types of devices that can be used for blasting. One common system is known as an air blast system. In an air blast system, a stream of compressed air carrying the blast media is released through a fixed nozzle, or manipulated by an operator or robotic device, and allowed to impinge a work surface. Although air blast systems are widely used, one drawback to using an air blast system is that the effective work area for the system is relatively small. For example, a conventional air blast system having a ⅜ inch diameter nozzle fed by a 30 HP compressor may propel approximately 3 pounds of media per minute, with an effective work surface area of about 2 square inches. Air blast systems also are relatively noisy and require large or powerful air compressors.

Another type of device that can be used for blasting is a centrifugal blast system. In a centrifugal blast system, a spinning wheel is used to accelerate the blast media. Centrifugal blast systems are capable of delivering much more blast media over a much larger area than a comparable air blast system, while using less power and generating less noise. In a typical centrifugal blast system, the blast media enters a spinning wheel (referred to herein as a blast wheel) at a central location and is radially accelerated by centrifugal force toward the outside of the blast wheel. The blast wheel is typically provided with several similarly configured radially mounted blades, or vanes, that serve to channel and accelerate the blast media. The exit velocity of the particles of blast media leaving the blast wheel may be adjusted, inter alia, by adjusting the size of the blast wheel or by adjusting the rotational velocity of the blast wheel.

Many blasting applications use metallic particles as blast media. However, where ferrous contamination is undesirable or unacceptable or a particular surface finish is required, such as in the automotive, die casting and aerospace industries, metallic media typically cannot be used. In these applications, non-metallic media must be used, such as glass beads, ceramic beads, plastic beads, agri-shell, and baking soda. Likewise, it may be desirable to replace metallic media with softer non-metallic media for certain applications, such as removing paint and coatings while preserving the condition of the underlying surface. Since many non-metallic blast media are breakable, non-metallic media will be referred to hereinafter "friable."

Unfortunately, when friable blast media is used with a conventional centrifugal blast apparatus, a large percentage of the media are destroyed. For example, it has been found that up to approximately 80–100% of the friable media may be destroyed in one cycle through a conventional centrifugal blast apparatus. Since typical centrifugal blast systems recover and recycle the blast media, destruction of blast media significantly increases the cost of operation of the system. The problem therefor is to provide a centrifugal blasting apparatus that is configured to deliver friable media with minimal destruction of the delivered media. This invention provides a solution to this problem.

U.S. Pat. No. 6,126,516 discloses a centrifugal blasting apparatus which is configured to deliver friable media without destroying a large percentage of the delivered media. The centrifugal blasting apparatus includes a compressed air feed system that intermixes and fluidizes blast media with compressed air and delivers the fluidized blast media to a blast wheel. A control cage is formed with rounded interior surfaces to avoid sharp transitions that may otherwise fracture the media. The blades are curved to maximize acceleration of the blast media with the lowest possible rotational rate. The first of the blades adjacent to the axis of rotation are configured to receive the blast media and are rounded to minimize the amount of blast media that is broken. The channels on the blades are polished to minimize the amount of blast media that is broken while traveling along the surface of the blades.

SUMMARY OF THE INVENTION

This invention relates to a blasting apparatus, comprising: a fan mounted for rotation in a first horizontal plane about a vertically oriented axis of rotation; a dispensing plate mounted for rotation in a second horizontal plane about the vertically oriented axis of rotation, the second horizontal plane being positioned below the first horizontal plane; and a passage configured to deliver blast media to the dispensing plate.

This invention further relates to a process for accelerating blast media, comprising: delivering the blast media to a dispensing plate mounted for rotation about a vertically oriented axis of rotation, the dispensing plate being positioned below a fan mounted for rotation about the vertically oriented axis of rotation; and rotating the dispensing plate and the fan, the blast media flowing off the dispensing plate, the rotating fan forcing air downwardly into contact with the blast media causing the blast media to accelerate.

DETAILED DESCRIPTION OF THE INVENTION

Figure 1:
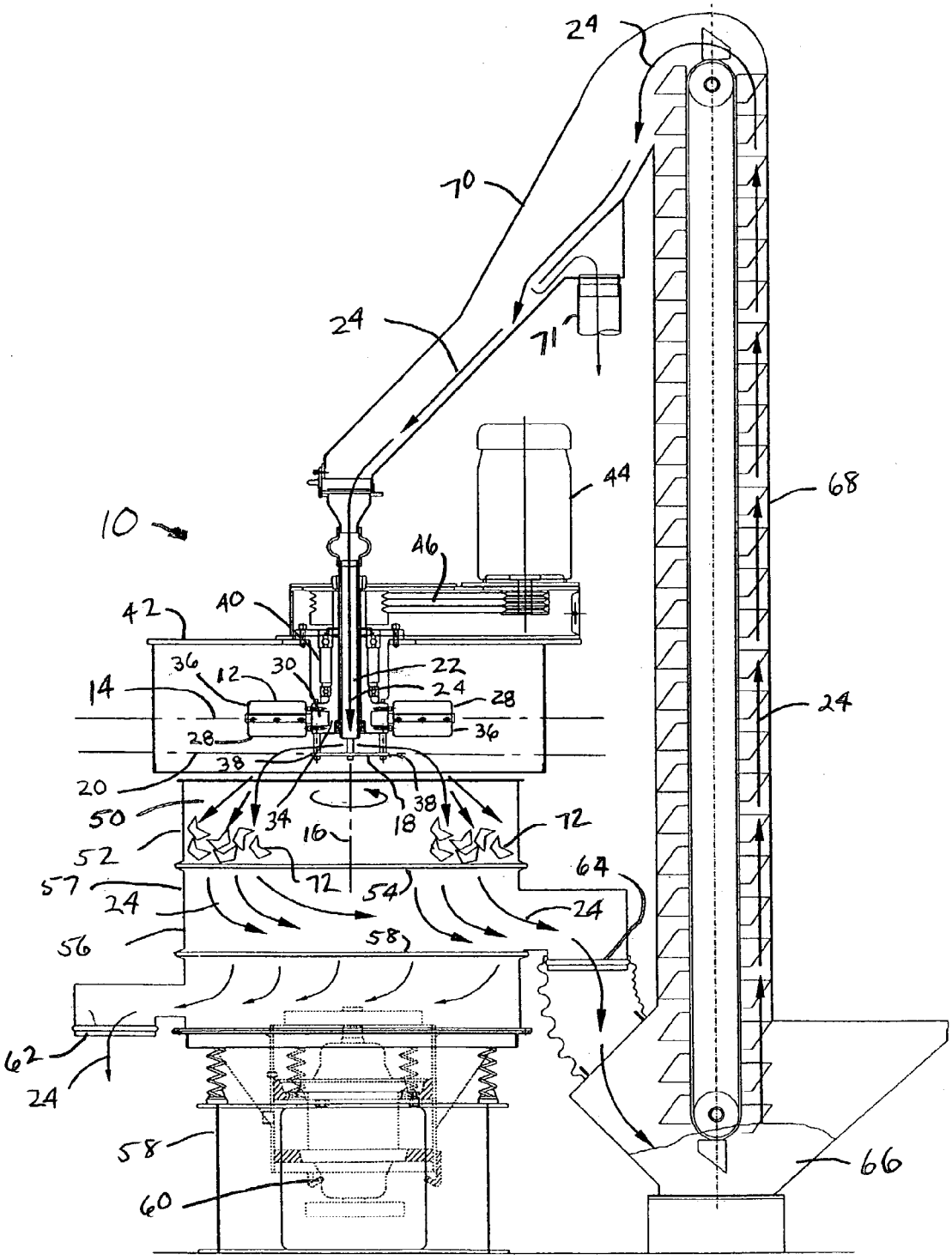
FIG. 1 is a schematic illustration of the inventive blasting apparatus in a particular form.

The inventive blasting apparatus will now be described with reference to FIG. 1. Referring to FIG. 1, the inventive blasting apparatus 10 comprises: a fan 12 mounted for rotation in a first horizontal plane indicated by centerline 14 about a vertically oriented axis of rotation indicated by centerline 16; a dispensing plate 18 mounted for rotation in a second horizontal plane indicated by centerline 20 about the vertically oriented axis of rotation 16; and a passage or center tube 22 configured to deliver blast media indicated by arrows 24 to the dispensing plate 18.

The fan 12 contains at least one fan blade 28, and may contain any suitable number of fan blades 28. The fan 12 may contain, for example, from 1 to about 8 fan blades, and in one embodiment about 2 to about 6 fan blades, and in one embodiment about 3 to about 5 fan blades, and in one embodiment 4 fan blades equally spaced around the vertical axis of rotation 16. Where only one fan blade 28 is used, a suitable counterweight may be used to balance the fan 12. The fan blades 28 are mounted on fan blade support ring 30. The fan blades 28 are configured to provide a generally downwardly flow of air when rotated. Support ring 30 is mounted on bearing assembly 40.

Dispensing plate 18 is mounted on dispensing plate mounting posts 32 which depend from fan blade support ring 30. Any number of mounting posts 32 may be provided to mount dispensing plate 18 in a secure fashion. For example, three, four or five equally spaced mounting posts 32 may be used. Fan blade support ring 30 has a center opening 34 which permits passage 22 to extend through fan blade support ring 30 and below fan 12 to permit delivery of the blast media 24 to the center of dispensing plate 18. The dispensing plate 18 may have any suitable shape. In one embodiment, dispensing plate 18 is in the form of a circular disk. The outer ends 36 of fan blades 28 extend beyond the outer edge 38 of dispensing plate 18.

The fan 12 and dispensing plate 18 are contained within cylindrical housing 42. A motor 44 is mounted on housing 42 and connects to bearing assembly 40 through V-belts 46. Bearing assembly 40 is mounted on housing 42. The motor 44 and bearing assembly 40 are configured to provide rotational movement to fan 12 and dispensing plate 18 about axis of rotation 16. The motor 42 may be any known motor that is capable of producing a rotational driving force, such as an electric motor or solenoid, a motor fueled by one or more fossil fuels such as an internal combustion engine such as (e.g., spark ignited or gasoline engine or a compression ignited or diesel engine), a pneumatic motor, a hydraulic motor, a steam engine, or any one of a number of other motors.

Work area 50 is positioned below housing 42, fan 12 and dispensing plate 18. Work area 50 is contained within cylindrical housing 52 and screen mesh bottom 54. Screen separator assembly 56 is positioned below work area 50.

Screen separator assembly 56 includes cylindrical housing 57, screen mesh separator 58, and chutes 62 and 64. Screen separator assembly 56 is mounted on screen vibrator assembly 58 which includes vibrator motor 60. The blasting apparatus 10 also includes blast media source 66, bucket elevator 68 and feed chute 70. Feed chute 70 includes trap 71 for removing fine particulates.

In operation, blast media is conveyed from blast media source 66 through bucket elevator 68 to feed chute 70 as indicated by arrows 24. The blast media flows downwardly through feed chute 70 to passage 22 and from passage 22 to the center of dispensing plate 18. Dispensing plate 18 and fan 12 are rotated by motor 44. The rotational movement of dispensing plate 18 imparts a centrifugal force on the blast media positioned on the dispensing plate 18. The centrifugal force causes the blast media to flow from the center of dispensing plate 18 to its outer edge 38 and then off the dispensing plate 18. As the blast media flows off dispensing plate 18, forced air from the rotation of fan blades 28 accelerates the flow of the blast media in a generally downwardly direction within work area 50, as indicated by arrows 24. The work pieces 72 to be treated in accordance with the inventive process are contained within work area 50. After contacting the work pieces 72, the blast media flows through screen mesh bottom 54 to screen separator assembly 56. In screen separator assembly 56, the blast media, which at this point in the process consists of a mixture of fine particulates and larger particulates, is separated. The fine particulates flow through chute 62 from where they are collected and discarded. The larger blast media particulates flow through chute 64 and are returned to blast media source 66 for recycling.

The blast media may be any blast media known in the art, including metallic media and non-metallic media. However, the inventive process is particularly suitable for using non-metallic or "friable" media. The blast media may consist of glass beads, ceramic beads, plastic beads, agri-shells, baking soda, and the like. The inventive process is particularly suitable for using glass beads. In one embodiment, the blast media consists of glass beads having an average particle size in the range of about 0.006 to about 0.025 inch.

The work pieces 72 may be any work pieces suitable for treatment in a blasting process. These may include work pieces requiring the removal of paint, rust and/or other coatings or built up debris. The inventive blasting process may be used to clean, descale, debur, deflash, peen, etch, or enhance the appearance of the work pieces 72.

An advantage of the inventive process is that the blast media is fed into the fan blades 28 at the same rate of speed as the rotating blades. This results in significant reduction in the amount of blast media that is broken during the inventive process.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A blasting apparatus, comprising:

a fan mounted for rotation in a first horizontal plane about a vertically oriented axis of rotation;

a dispensing plate mounted for rotation in a second horizontal plane about the vertically oriented axis of rotation, the second horizontal plane being positioned below the first horizontal plane; and a passage configured to deliver blast media to the dispensing plate.

2. The apparatus of claim 1 wherein the fan comprises at least one fan blade.

3. The apparatus of claim 1 wherein the fan is configured to force air in a generally downward direction when rotated.

4. The apparatus of claim 1 wherein the dispensing plate is in the form of a circular disk.

5. The apparatus of claim 1 wherein the fan has a center opening and the passage extends through the center opening of the fan.

6. The apparatus of claim 1 wherein the fan and dispensing plate are mounted in a cylindrical housing.

7. The apparatus of claim 1 wherein the blasting apparatus further comprises a motor that is configured to rotate the fan and the dispensing plate.

8. The apparatus of claim 1 wherein the apparatus further comprises a bucket elevator and a feed chute to deliver blast media to the dispensing plate.

9. The apparatus of claim 1 wherein the blasting apparatus further comprises a work area positioned below the fan and the dispensing plate.

10. The apparatus of claim 9 wherein the work area comprises a cylindrical housing with an open top and screen mesh bottom.

11. The apparatus of claim 10 wherein a screen separator is positioned below the screen mesh bottom of the work area.

12. The apparatus of claim 11 wherein the screen separator is connected to a motor that is configured to provide vibrational motion to the screen separator.

13. A process for accelerating blast media, comprising:

delivering the blast media to a dispensing plate mounted for rotation about a vertically oriented axis of rotation, the dispensing plate being positioned below a fan mounted for rotation about the vertically oriented axis of rotation; and rotating the dispensing plate and the fan, the blast media flowing off the dispensing plate, the rotating fan forcing air downwardly into contact with the blast media causing the blast media to accelerate.

14. The process of claim 13 wherein the accelerated blast media contacts a work piece.

15. The process of claim 13 wherein the dispensing plate is in the form of a circular disk.

16. The process of claim 13 wherein the fan has a center opening, the blast media flowing through the center opening of the fan to the dispensing plate.

17. The process of claim 13 wherein the fan and dispensing plate are mounted in a cylindrical housing.

18. The process of claim 13 wherein the rotational movement of the fan and the dispensing plate is driven by a motor.

19. The process of claim 13 wherein the blast media is delivered to the dispensing plate using a bucket elevator and a feed chute.

20. The process of claim 14 wherein the work piece is positioned in a work area below the fan and the dispensing plate.

21. The process of claim 20 wherein the work area comprises a cylindrical housing with an open top and screen mesh bottom, the blast media contacting the work piece and flowing through the screen mesh bottom.

22. The process of claim 21 wherein a screen separator is positioned below the screen mesh bottom of the work area, the blast media flowing through the screen mesh bottom comprising a mixture of fine particulates and larger particulates, the screen separator separating the fine particulates from the larger particulates.

23. The process of claim 22 wherein the screen separator is vibrated.

24. The process of claim 13 wherein the blast media comprises a friable media.

25. The process of claim 13 wherein the blast media comprises glass beads.

* * * * *